US007380384B2

(12) United States Patent
Bourly

(10) Patent No.: US 7,380,384 B2
(45) Date of Patent: Jun. 3, 2008

(54) LAYOUT FOR SHOP WINDOW CONSTRUCTION, AS WELL AS A WINDOW FRAME, GLAZED DOOR AND/OR SIMILAR, COMPOSED OF SUCH A LAYOUT

(76) Inventor: Jean Bourly, 19, rue Gerusez, 51100 Reims (FR)

( * ) Notice: Subject to any disclaimer, the term of this patent is extended or adjusted under 35 U.S.C. 154(b) by 482 days.

(21) Appl. No.: 10/852,297

(22) Filed: May 24, 2004

(65) Prior Publication Data

US 2004/0255528 A1 Dec. 23, 2004

Related U.S. Application Data

(63) Continuation-in-part of application No. 10/121,451, filed on Apr. 12, 2002, now abandoned.

(30) Foreign Application Priority Data

Apr. 19, 2001 (FR) ..... 01 05302

(51) Int. Cl.
*E04C 2/38* (2006.01)

(52) U.S. Cl. ..... 52/656.6; 52/656.5; 52/656.2; 52/656.7; 52/656.1; 52/734.1; 219/137 R; 219/125.1; 219/137 WM

(58) Field of Classification Search ..... 52/656.6, 52/656.5, 656.7, 656.2, 656.1, 204.6, 734.1; 219/137 R, 137 WM, 125.1
See application file for complete search history.

(56) References Cited

U.S. PATENT DOCUMENTS 1,699,021 A * 1/1929 Reuter ..... 52/768
1,900,161 A * 3/1933 Cohan ..... 219/91.23
3,486,288 A * 12/1969 Pyne ..... 52/730.5
3,686,805 A * 8/1972 Pofferi ..... 52/64
3,703,063 A * 11/1972 Budich et al. ..... 52/734.1
3,848,387 A * 11/1974 Hafner ..... 52/731.3
3,881,287 A * 5/1975 Biebuyck ..... 52/127.1
3,899,858 A * 8/1975 Zanker ..... 52/172
3,920,344 A * 11/1975 Anderson ..... 403/401
3,964,231 A * 6/1976 Budich et al. ..... 52/734.1
3,994,243 A * 11/1976 Anders ..... 109/2
4,040,219 A * 8/1977 Budich ..... 52/209
4,181,396 A * 1/1980 Olashaw ..... 439/801
4,428,156 A * 1/1984 Malm et al. ..... 49/501
4,569,154 A * 2/1986 Bayer ..... 49/504

(Continued)

*Primary Examiner*—Jeanette Chapman
*Assistant Examiner*—Dan Kenny
(74) *Attorney, Agent, or Firm*—Egbert Law Offices

(57) ABSTRACT

A layout for shop window construction includes a dormant frame and an opening frame of a closed tubular section defining an internal volume, the opening or dormant frames appearing in the form of an assembly of the profiles defining the closed tubular section, the profiles being joined edge against edge by their ends $e_1$ $e_2$. Each profile includes at least an opening element and a closing element and a fixation device for between the profiles, each opening element including at least a web and two wings defining at least two edges known as longitudinal, extending from one end to another of the profiles and connected wholly in part to the web and/or to said the wings. The fixation device includes an internal welding completing the volume, connecting the profiles at the level of their junction, the welding being envisaged before closing of volume by the closing element. The invention also relates to a window frame, glazed door and/or similar, composed of such a frame.

6 Claims, 6 Drawing Sheets

U.S. PATENT DOCUMENTS 4,640,048 A * 2/1987 Winner et al. ..... 49/181
4,676,026 A * 6/1987 Schreiner ..... 49/501
4,689,933 A * 9/1987 Biro ..... 52/656.5
4,741,474 A * 5/1988 Potet et al. ..... 228/190
4,752,350 A * 6/1988 Schuster ..... 156/379.6
4,884,376 A * 12/1989 DeBlock et al. ..... 52/92.2
4,918,882 A * 4/1990 Funk ..... 52/86
4,995,213 A * 2/1991 Bezubic ..... 52/656.5
5,046,791 A * 9/1991 Kooiman ..... 312/265.1
5,090,164 A * 2/1992 Mische ..... 52/90.1
5,197,253 A * 3/1993 Johnson ..... 52/646
5,363,615 A * 11/1994 Christopher et al. ..... 52/272
5,394,664 A * 3/1995 Nowell ..... 52/200
5,449,107 A * 9/1995 Umeno et al. ..... 228/50
5,479,733 A * 1/1996 Kusina ..... 40/785
5,655,348 A * 8/1997 Paradise ..... 52/656.4
5,771,640 A * 6/1998 Back ..... 52/90.1
5,896,482 A * 4/1999 Blee et al. ..... 385/107
6,378,253 B1 * 4/2002 Richardson ..... 52/204.5
6,622,441 B2 * 9/2003 Miller ..... 52/204.1

* cited by examiner

LAYOUT FOR SHOP WINDOW CONSTRUCTION, AS WELL AS A WINDOW FRAME, GLAZED DOOR AND/OR SIMILAR, COMPOSED OF SUCH A LAYOUT

RELATED U.S. APPLICATIONS

The present utility patent application is a continuation-in-part application of U.S. patent application Ser. No. 10/121,451, filed on Apr. 12, 2002 and entitled "LAYOUT FOR SHOP WINDOW CONSTRUCTION, AS WELL AS A FRAME AND A CHASSIS FOR A WINDOW, GLAZED DOOR AND/OR SIMILAR, COMPOSED OF SUCH A LAYOUT", now abandoned. U.S. application Ser. No. 10/121,451 claims priority from French Application No. 01/05302 filed on Apr. 19, 2001.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The invention concerns a layout for shop window construction, as well as a window frame, glazed door and/or similar, composed of such a layout.

BACKGROUND OF THE INVENTION

Currently, in the field of shop window construction, it is known to use frames or chassis formed of profiles, of closed cross-section steel, each delineating one of the sides of said frame or chassis and assembled together, edge to edge, by their ends. To do so, a weld seam is provided, on the exterior, at the level of the junction of the profiles, on the visible surfaces.

Although it is quite widespread, such a solution exhibits numerous shortcomings. The weld seam is not aesthetic and must be partially eliminated so that the manufactured frame or chassis preserves a satisfying aspect. Such a partial elimination of the weld seam is also necessary to allow correct operation of the fitted window, glazed door or similar. It is thus necessary to perform finish-machining operations, tricky to be performed.

Besides, these operations weaken the resistance of the weld seam up to 50 or 60% of its initial resistance. The frame or chassis loses some of its strength. Its water and air tightness properties also decrease, which limits its insulation power.

Besides, the presence of an external weld seam makes finishing operations more difficult such as, for example, polishing, application of patina or others.

The purpose of the invention is to propose a layout for shop window construction, consisting of a dormant frame and an opening frame, a closed tubular section defining an internal volume, which mitigates the above-mentioned disadvantages, and in which the profiles are fixed one to the other, without harming the aesthetic aspect of the aforesaid arrangement, while ensuring its robustness and/or its sealing.

Another purpose of the invention is to suggest a layout of assembled shop window profiles, edge to edge, by their ends whereof the finishing operations are facilitated.

Another purpose of the invention is to suggest a layout of shop window profiles, assembled edge to edge, by their ends wherein the fastening means of the profiles together can be masked, on the inside of their aforementioned closed tubular section.

Other purposes and advantages of the invention will appear during the following description which is only given for exemplification purposes and which does not purport to limit said invention.

BRIEF SUMMARY OF THE INVENTION

The invention relates to a layout for shop window construction, consisting of a dormant frame and an opening frame, of a closed tubular section defining an internal volume, said dormant frame and opening frame presenting themselves in the form of fitting of sections defining said closed tubular section, said profiles joined edge to edge on their ends, each profile including at least an opening element, a closing element and a means of fixing the profiles between them, each opening element including at least, a web and two wings defining at least two edges known as longitudinal, extending from one end to the other of the profile and connected wholly or in part to it or said webs and to it or said wings, said fixation means consisting of a completely internal welding to that volume, connecting said profiles to the level of their junction, said welding being intended before closing of said volume by the closing element.

According an advantageous embodiment, the metal profiles of the layout according to the invention are composed of bronze. They exhibit therefore a top range effect.

Besides, it should be noted that with such a material, the realization of an internal weld seam is particularly necessary for the layout to keep its aesthetic aspect. Indeed, the bronze being an alloy, the material used for welding exhibits compulsorily a tone different of the tone of the profiles. It is therefore necessary to be able to mask said weld seam to preserve the effect desired.

The invention also concerns a window frame, glazed door and/or similar, constituted from a fitting of profiles, as described above.

BRIEF DESCRIPTION OF THE SEVERAL VIEWS OF THE DRAWINGS

The invention will be understood better when reading the following description together with the appended drawings.

DETAILED DESCRIPTION OF THE INVENTION

Figure 1:
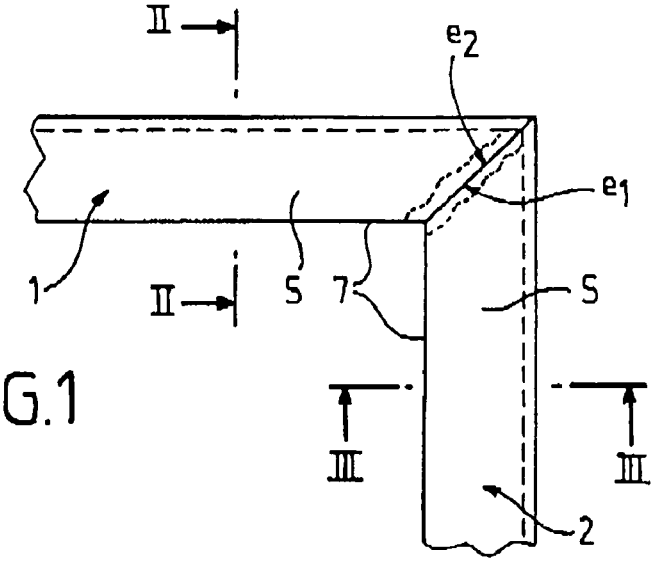
FIG. 1 is a partial front schematic view of an embodiment of the layout according to the invention.
Figure 2:
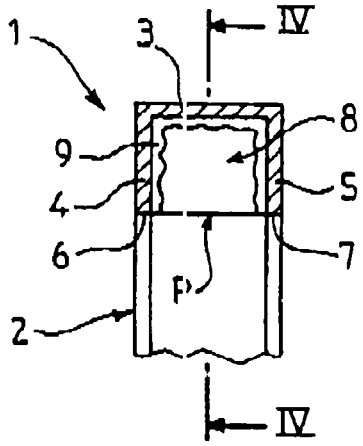
FIG. 2 is a cross-sectional view along the line II-II represented on previous FIG. 1.
Figure 3:
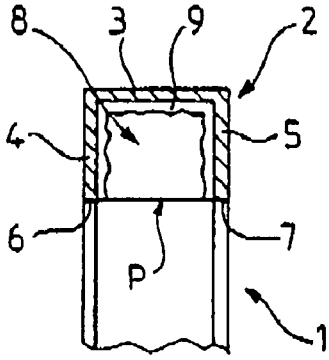
FIG. 3 is a cross-sectional view along the line III-III represented on previous FIG. 1.
Figure 4:
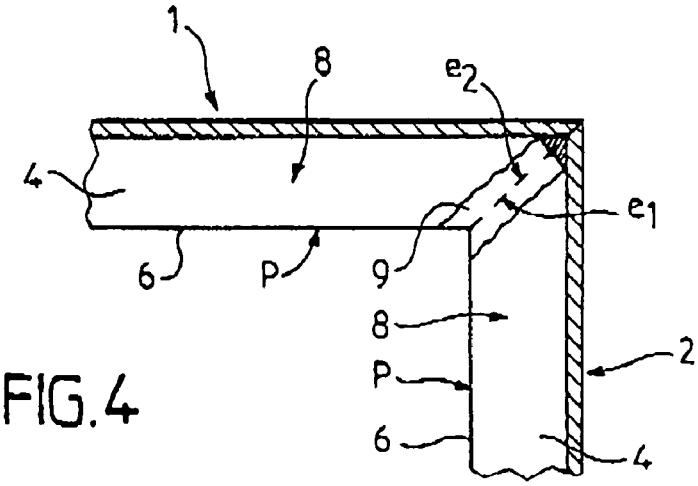
FIG. 4 is a cross-sectional view along the line IV-IV represented on previous FIG. 2.

The invention relates, first of all, to a layout for shop window construction, a dormant frame and an opening frame, each one of a closed tubular section defining an internal volume 8. Said dormant frame and opening frame presenting themselves in the form of fitting of profiles 1,2 defining said closed tubular section.

As illustrated on FIGS. 1 to 4, in the layout according to the invention, the profiles 1, 2 are joined edge to edge, by their ends $e_1$, $e_2$.

Said profiles 1, 2, are for example, perpendicular two by two. Their ends can be chamfered. The edges of the ends of said profiles will therefore be tilted, notably, of approx. 45° with respect to their longitudinal edges.

According to the invention, each section 1,2 includes at least an opening element 3,4,5, a closing element 17, and means of fixing the profiles between them.

Each opening element includes at least a web 3 and two wings 4,5, defining at least two edges 6,7, known as longitudinal, extending from one end to another of the section 1,2, and connected wholly or in part to said web(s) 3 or to said wing(s) 4,5.

Each of said profiles defines said volume 8, called internal, circumscribed in particular by said web(s) 3 and said wing(s) 4,5 connecting said longitudinal edges 6,7 and by virtual plane P passing through said edges.

Said profiles 1,2 thus exhibit a "semi-open" right section, i.e. extending according to at least two different directions and said profiles are in themselves neither tubular nor composed of a simple plan metal bond. Said "semi-open" profiles are, after their junction, equipped with a closing element 17, not represented in FIGS. 1 to 4.

As developed further, said profiles can exhibit a U-shaped section or others.

According to the invention, to enable to link said profiles 1,2, said layout comprises fastening means composed of a weld seam 9 completely internal of said volume 8, linking said profiles at their junction $e_1$, $e_2$, said weld seam 9 being created before closing of said volume 8 by closing element 17.

By providing "semi-open" profiles and by placing the weld seam 9 in the internal volume that they delineate, said weld seam 9 is thus masked and need not be eliminated partially, as previously. The link between the profiles is thus made stronger and tighter. Similarly, there is no excessive thickness of material cue to the weld seem being available at the external faces of the profiles, and the finishing works of said excessive thickness are facilitated.

Figure 5:
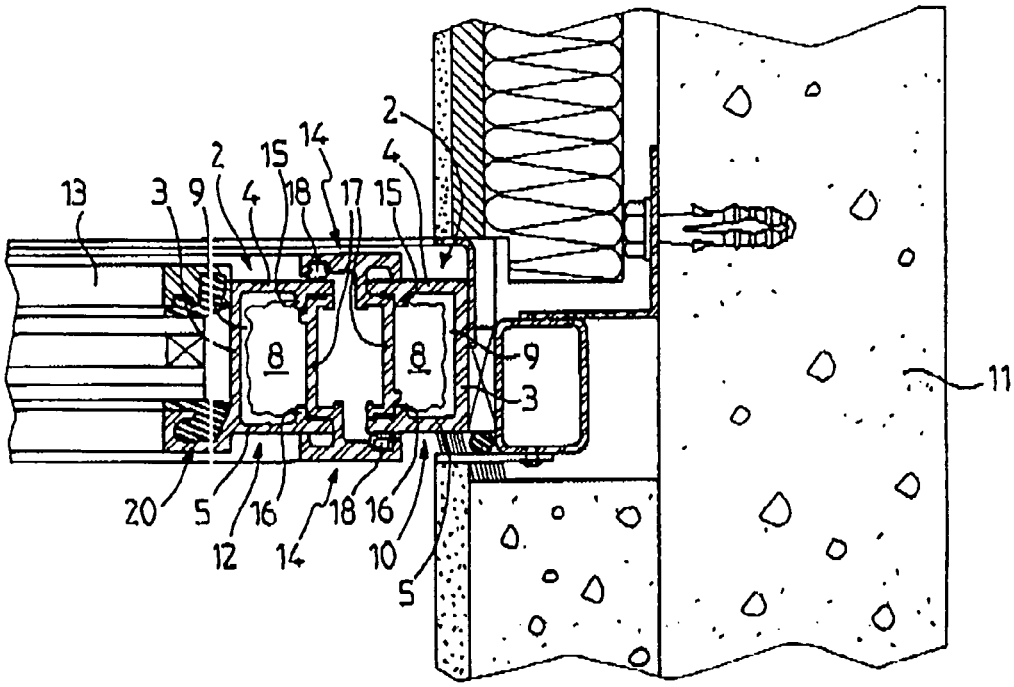
FIG. 5 is a partial sectional view according to a transversal cross-sectional plane of a window, glazed door and/or similar comprising other embodiments of the layout according to the invention, forming a frame and a chassis also complying with the invention.

FIG. 5 illustrates a vertical stanchion 10 of a first method of realization of the frame, in particular a dormant frame, slaved to a wall 11, and a vertical stanchion 12 of a second layout, notably a chassis, to which panes are slaved, notably double glazing.

As illustrated by this particular example, all or part of the profiles 1, 2 layouts according to the invention can be fitted with closing means 14 of a portion at least of their internal volume 8. It will be thus possible to mask said weld seam 9 entirely on the interior of the closed section thus formed.

The latter is more particularly intended, for example, along the portion of said web(s) 3 and of said wing(s) 4, 5 being in the portion of said internal volume 8 sealed said closing means 17. Said closing means 17 can besides extend from one end to the other of said profiles.

Said profiles 1,2 which constitute said frame, present on each of said wings 4,5 a stop 15,16 one on the other, on which the closing element 17 is supported. Stop(s) 15,16 have the advantage of being used as support for the closing element 17 and simultaneously of limiting welding 9 on the interior of said volume 8.

Figure 7:
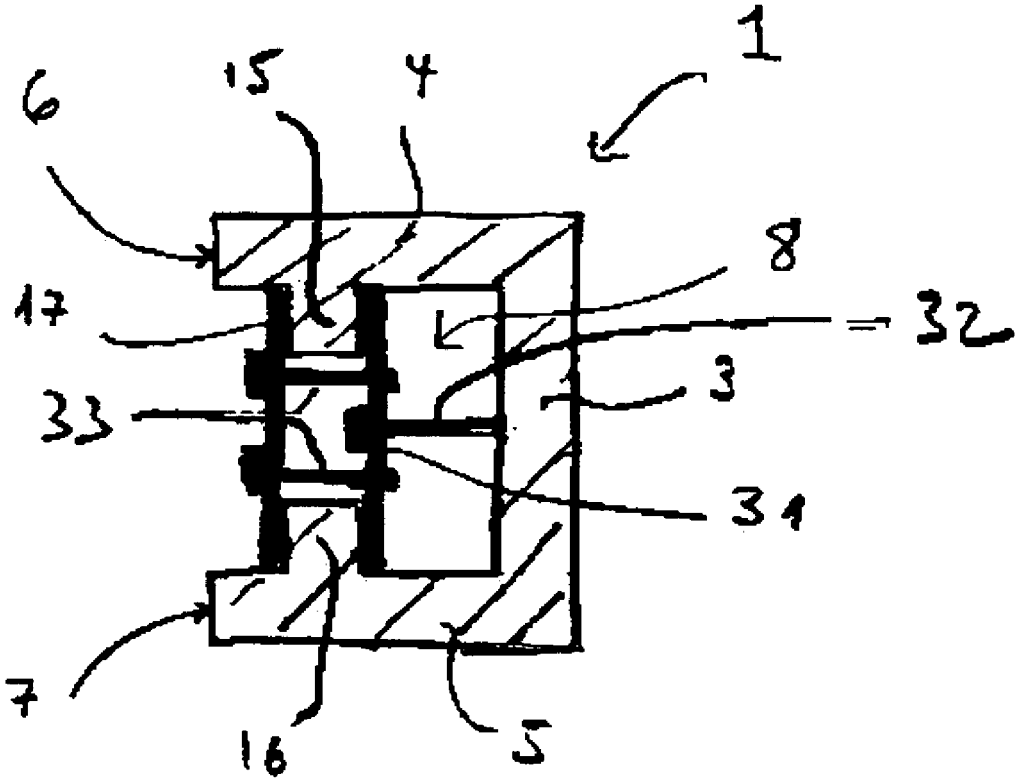
FIG. 7 shows a partial sectional view of the profile illustrated in FIG. 6*a* equipped with its closing element.

According to the present invention, as illustrated at FIG. 7, the assembly of the opening element 3,4,5 with the closing element 17 is carried out with the means of a clamp 31, held inside volume 8, and on which closing element 17, once supported on stops 15, 16 comes to be fixed, in particular, by screwing.

In particular, in the groove created by web 3, wings 4,5 and stops 15,16 one or more threaded clamps 31 are threaded, then are maintained pressed against said stops by at least a screw 32 supported on the one hand on web 3 and on the other hand on clamp 31.

The closing elements 17 can then be envisaged resting against said stops 15,16 and be fixed by means of screw 33, said stops 15,16 being enclosed between clamp 31 and the closing element 17, as illustrated in FIG. 7.

Said closing elements 17, called beats, may accommodate a gasket 18.

As illustrated on FIG. 5, the closing elements 17 closing each of the profiles 2 represented rest against one another by their gasket 18 when the window 13 is in closed position.

As regards the form of the profiles, as already mentioned, said form can be quite varied. For exemplification purposes, as illustrated on FIGS. 6*a* to 6*g*, said profiles comprise one said web 3 and at least two said wings 4, 5 extending opposite one another from ends of said web 3, perpendicularly to said ends.

Figure 6A:
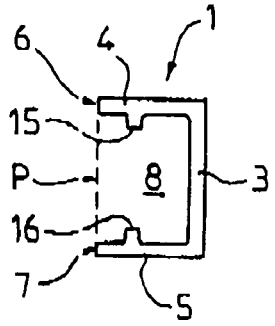
FIGS. 6*a* to 6*g* are sectional views showing different examples of profile sections of the layout according to the invention.

It can thus be defined a "basic" section, such as illustrated on FIG. 6*a*, wherein both wings 4, 5 exhibit the same length. With reference again to FIG. 5, it can be noted that the stanchion 10 of the frame exhibits such a section.

Figure 6B:
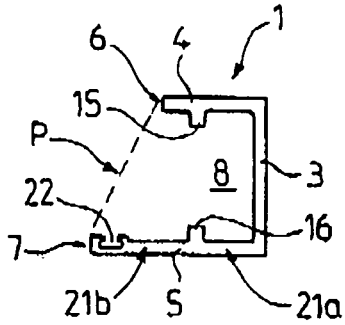
Figure 6C:
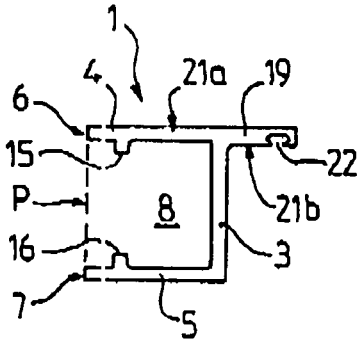
Figure 6D:
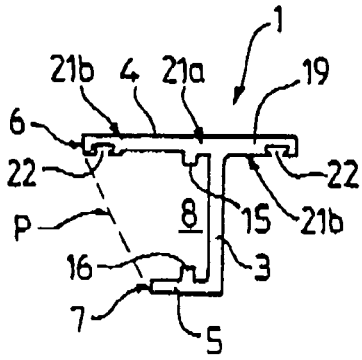
Figure 6E:
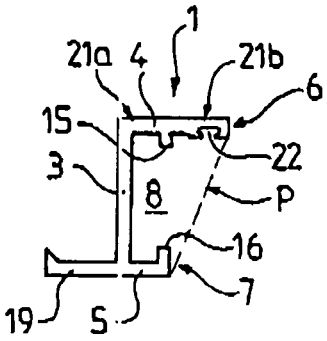
Figure 6F:
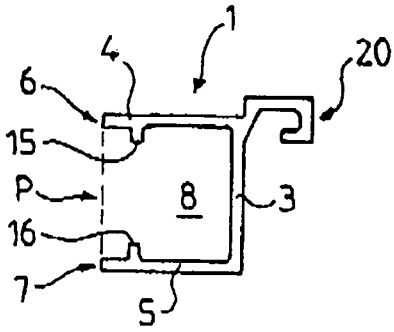
Figure 6G:
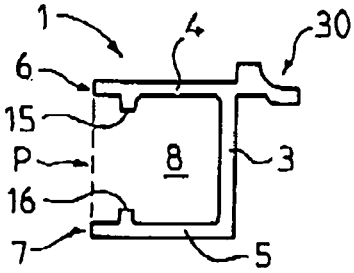

One of the wings 4,5 can also be prolonged beyond the other, such as is illustrated on FIG. 6*b*. It can also be extended by a third wing 19 situated on the other side of the web 3, as illustrated on FIG. 6*c*. Both previous characteristics can still be combined, either at the same wing, as illustrated on FIG. 6*d* or at the other wing, as illustrated on FIG. 6*e*.

With reference again to FIGS. 6*f* and 6*g*, it can be noted that the profiles according to the invention can also comprise a protuberance 20, notably intended to allow as well hooking a gasket as illustrated an FIG. 5 with the stanchion 12 of the chassis or an excessive thickness 30, notably intended for the realization of patterns by machining.

With reference again to FIGS. 6*b*, 6*c*, 6*d* or 6*e*, it can be noted that one 4 at least of said branches 4, 5 fitted with one of said stops 15, 16 exhibits, on the one hand, a first portion 21*a* delineating a portion of the contour of the internal volume 8 sealed by said closing means 17, and, on the other hand, a second so-called free portion 21*b*, exhibiting one said longitudinal specific groove 22, capable of accommodating a gasket. Said first and second portions 21*a*, 21*b* can be situated on either side of the stop 11 in question or on the same side, according to the profile used.

The profiles of a same layout according to the invention may exhibit the same section.

Consequently, as already mentioned, according to an advantageous embodiment, said profiles will be formed of bronze.

Said weld seam 9 is, for example, primarily based on copper. It may be, notably, a weld seam made of copper-aluminum.

Welding can be performed with an MIG-type device under argon-type neutral gas.

To assemble a layout according to the invention, one can proceed as follows. One positions against one another the ends, $e_1$, $e_2$ of the profiles 1,2 forming the layout. The junction can be welded at their internal volume 8 which can be sealed using the closing element 17.

One can also realize finishing operations such as polishing or applying a patina on the external surfaces of said profiles.

Figure 8:
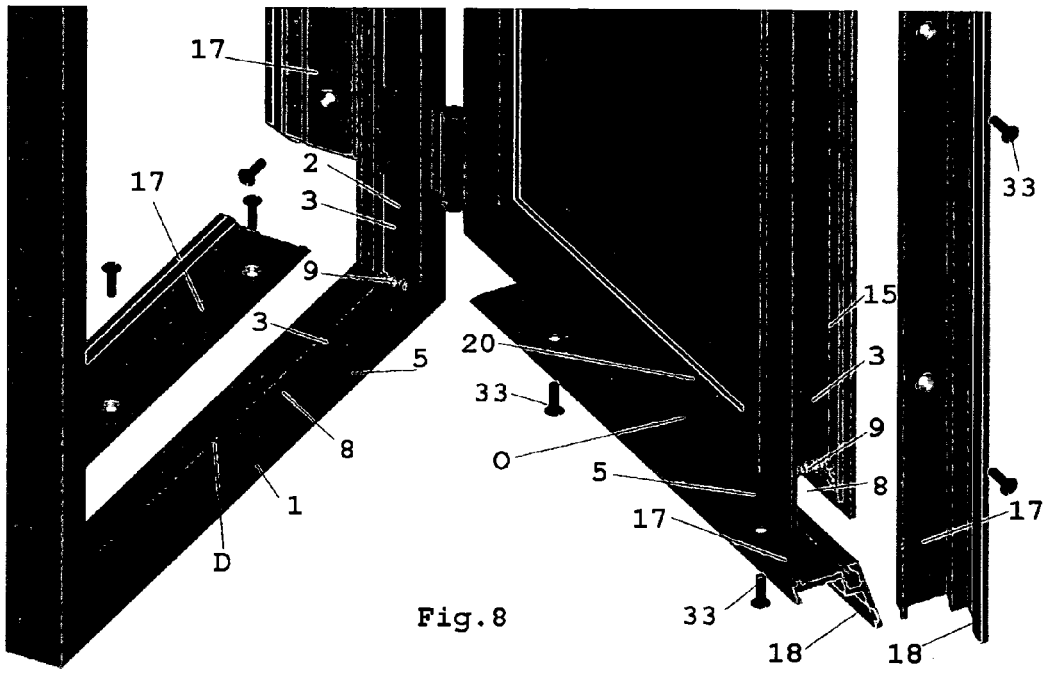
FIG. 8 is a partial exploded perspective view, in three dimensions, of an implementation of the profiles, illustrated in FIG. 6*a*, before their closing with their closing elements.

FIG. 8 shows, for better comprehension, a blown-up partial view, a dormant frame D and an opening frame O. Each frame presents a closed tubular section defining said internal volume 8 on the level of which said welding 9 is designed to carry out the junction of sections 1,2 edge against edge by their ends. After the welding of the junction, the sections can be closed thanks to closing element 17.

Figure 9:
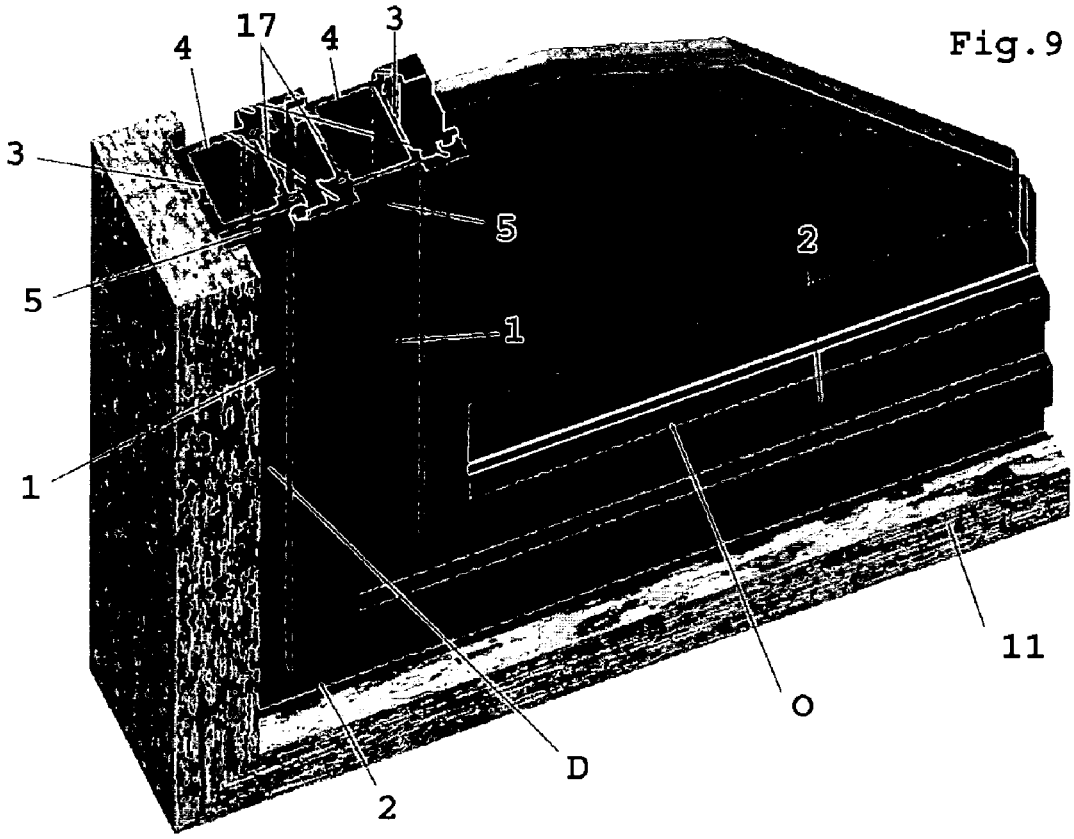
FIG. 9 is a partial sectional view, in three dimensions, of a profile of a finished window, as illustrated in cut view in FIG. 5.

FIG. 9 shows said dormant frame D and said opening frame O obtained from the specific assembly of the invention described above.

Naturally, other embodiments, available to the man of the art, could have been contemplated without departing from the framework of the invention.

I claim:

1. A shop window construction having a dormant frame and an opening frame, the construction comprising:

a first profile;

a second profile assembled to said first profile so as to define a closed tubular section, said second profile joined to said first profile in edge-to-edge relationship, each of said first and second profiles having an opening element and a closing element, said opening element having a web with a pair of wings connected to and extending from said web, said pair of wings defining a pair of edges respectively extending longitudinally extending from end-to-end along the profile; and a fixation means formed on said first and second profiles for connecting said first and second profiles in the end-to-end relationship, said fixation means being a welding formed entirely internally within an interior volume of said closed tubular section, said closing element separable from and extending across said interior volume between said pair of wings so as to cover said welding, each of said pair of wings having a stop extending inwardly, the stop of one of said pair of wings being opposite to the stop of the other of said pair of wings, said closing element supported on the stops; and a clamping means affixed to said opening element and to said closing element for fixing said closing element against the stops, said clamping means extending through said interior volume.

2. A shop window construction having a dormant frame and an opening frame, the construction comprising:

a first profile;

a second profile assembled to said first profile so as to define a closed tubular section, said second profile joined to said first profile in edge-to-edge relationship, each of said first and second profiles having an opening element and a closing element, said opening element having a web with a pair of wings connected to and extending from said web, said pair of wings defining a pair of edges respectively extending longitudinally extending from end-to-end along the profile; and a fixation means formed on said first and second profiles for connecting said first and second profiles in the end-to-end relationship, said fixation means being a welding formed entirely internally within an interior volume of said closed tubular section, said closing element separable from and extending across said interior volume between said pair of wings so as to cover said welding, at least one of said pair of wings having a stop extending into said internal volume, said closing element abutting said stop and extending across said interior volume, the wing having a longitudinal groove in spaced relation to said stop, said longitudinal groove suitable for receiving a seal therein.

3. The construction of claim 2, said pair of wings extending respectively perpendicularly from opposite sides of said web.

4. The construction of claim 2, each of said first and second profiles being formed of a bronze material.

5. The construction of claim 2, said welding being a copper-based material.

6. The construction of claim 2, said welding being of a copper-aluminum material.

* * * * *